United States Patent [19]

Wallow et al.

[11] Patent Number: 4,706,569

[45] Date of Patent: Nov. 17, 1987

[54] ARMOR BREAKING PROJECTILE

[75] Inventors: Peter Wallow, Düsseldorf; Bernhard Bisping, Ratingen, both of Fed. Rep. of Germany

[73] Assignee: Rheinmetall GmbH, Dusseldorf, Fed. Rep. of Germany

[21] Appl. No.: 701,431

[22] Filed: Nov. 9, 1984

Related U.S. Application Data

[63] Continuation of Ser. No. 295,551, Jul. 27, 1981, abandoned, which is a continuation-in-part of Ser. No. 213,171, Nov. 26, 1980, abandoned.

[30] Foreign Application Priority Data

Dec. 3, 1979 [DE] Fed. Rep. of Germany ..... 2948542

[51] Int. Cl.[4] ..... F42B 11/06

[52] U.S. Cl. ..... 102/518; 102/489; 102/521

[58] Field of Search ..... 102/501, 517–523, 102/489, 393, 438, 439; 244/3.24, 3.26

[56] References Cited

U.S. PATENT DOCUMENTS

| | | | |
|---|---|---|---|
| 1,447,198 | 3/1923 | Wright | 102/490 |
| 3,179,052 | 4/1965 | Jasse | 244/3.24 |
| 3,433,157 | 3/1969 | Joch | 102/503 |
| 3,585,934 | 6/1971 | Mueller | 102/703 |
| 3,842,741 | 10/1974 | Brothers et al. . | |
| 3,881,416 | 5/1975 | Dilworth, Jr. | 102/703 |
| 3,902,424 | 9/1975 | Dietsch et al. | 102/703 |
| 3,948,180 | 4/1976 | Silvia et al. . | |
| 4,036,140 | 7/1977 | Korr et al. | 102/703 |
| 4,036,141 | 7/1977 | Korr et al. | 102/703 |
| 4,063,486 | 1/1977 | Ashley | 102/520 |
| 4,284,008 | 8/1981 | Kirkendall et al. | 102/521 |

FOREIGN PATENT DOCUMENTS

| | | | |
|---|---|---|---|
| 477375 | 10/1915 | France | 102/489 |
| 2310547 | 5/1975 | France . | |
| 444885 | 11/1949 | Italy | 102/489 |
| 460516 | 1/1937 | United Kingdom . | |
| 671986 | 5/1952 | United Kingdom . | |
| 1085045 | 9/1967 | United Kingdom . | |
| 1278546 | 6/1972 | United Kingdom . | |
| 1323092 | 2/1973 | United Kingdom . | |
| 1364160 | 8/1974 | United Kingdom . | |
| 1408548 | 10/1975 | United Kingdom . | |
| 1538192 | 1/1979 | United Kingdom . | |
| 1548353 | 7/1979 | United Kingdom . | |
| 2036934 | 7/1980 | United Kingdom . | |

*Primary Examiner*—Harold J. Tudor

*Attorney, Agent, or Firm*—Karl F. Ross; Herbert Dubno

[57] ABSTRACT

A projectile, e.g. a subcaliber projectile to be fired from the barrel of a weapon, comprises an elongated main body having a central bore and forming a projectile of the inertial or impact type, the bore receiving a caliber or subcaliber auxiliary projectile and an appropriate charge so that a proximity fuse on the main projectile body can fire the auxiliary projectile body in an armor breaking fashion to facilitate penetration by the main body of the armored vehicle. Both projectiles are of the impact or inertial type in which their kinetic energy enables them to pierce the armor.

7 Claims, 8 Drawing Figures

ARMOR BREAKING PROJECTILE

CROSS-REFERENCE TO RELATED APPLICATION

This is a continuation of co-pending application Ser. No. 295,551 filed on July 27, 1981, now abandoned, which is a continuation-in-part of Ser. No. 213,171 filed on Nov. 26, 1980, now abandoned.

FIELD OF THE INVENTION

Our present invention relates to an armor-breaking or armor-piercing projectile and, more particularly, to a projectile of the impact type which has been found to be especially effective against active armor, e.g. of tanks, personnel carriers and mobile artillery.

BACKGROUND OF THE INVENTION

Modern armored vehicles have been, of late, increasingly equipped with platen-like, plate-like, or lamella-like armored walls, referred to hereinafter as layered armor, which form so-called multiple targets and structured targets against which earlier even high-velocity subcaliber projectiles have a limited penetration. Such vehicles can also have so-called "active" armor which contains an interference charge which is triggered upon impact to shield the vehicle from the projectile, dislocate the latter or otherwise reduce or prevent penetration.

It has been proposed heretofore to attack such active armor and so-called multiple targets and structured targets by impact projectiles which pierce the multilayer ablative armor by progressively breaking through the layers.

The term "impact projectile" is thus used to refer to a projectile which pierces the armor mainly, if not exclusively, as a result of its kinetic energy and mass, only a limited portion of the penetration at best being a result of any armor-breaking warhead which may explode upon contact with the armor. In fact, in most impact projectiles of the aforedescribed type, no explosion occurs upon contact of the projectile with the armor.

Reference may be had to the inertial or impact projectile described in the commonly assigned copending application Ser. No. 949,067 of Sept. 5, 1978 now abandoned and replaced by Ser. No. 412,794 of Aug. 23, 1982, this projectile having a plurality of cores or elements of hard metal which successively penetrate the layers of multiple and structured targets and active armor of the aforedescribed type.

Apart from the inertial or impact projectiles of the aforedescribed type, the art is aware of systems in which a main element of a projectile is provided with an auxiliary element which is substantially similar to the main element although the latter is much larger than the auxiliary element and the auxiliary element is caused to be effective against the target before the effective point of the main element. In short, in such weapons, the auxiliary element serves to initiate penetration of the target and improve the efficiency of the penetration of the main element.

A projectile in accordance with the principles described above is the subject of French Pat. No. 2,310,547.

The main device is, in this case, a so-called hollow or shaped charge with a conical liner or insert whose diameter corresponds to the inner diameter of the casing or sheath. At an axial spacing ahead of this main device, in the firing direction or direction of flight toward the target, is provided an auxiliary device with a hollow or shaped charge of reduced diameter. The latter, upon striking an active armor on a target vehicle, explodes and facilitates penetration of the main charge and its spike-forming insert.

Thus the prior-art arrangement described above has so-called tandem hollow charges which, experience has shown, undergo undesirable energy scattering or dissipation in directions other than the impact or armor-breaking direction.

Such scattering may result in frequently unavoidable deviations from symmetry of the spike-forming insert or from the relationship of the tandem charges to one another, i.e. deviations from exact axial alignment, or from the effect of the interference charges of active armor.

Furthermore, the explosions of the two charges directly follow one another from a time point of view and there is an unavoidable reaction on the part of the smaller initially exploded charge against the energy released by the larger hollow charge in spite of the fact that the charges are effective in the same region of the target.

For this purpose, a standoff must be provided for the smaller or initially exploded hollow charge which may result in non-overlapping effects of the penetration of the two charges.

OBJECTS OF THE INVENTION

Faced with the problems encountered with tandem hollow charge arrangements, it is the object of the present invention to provide a projectile which eliminates the disadvantages of this earlier system and provides a more efficient penetration of active, structured or multiple target armor of a vehicle such as a tank, personnel carrier or armored-artillery vehicle.

Another ojbect of the invention is to provide a projectile which allows full utilization of the penetrating effectiveness of an auxiliary device with optimum subsequent penetration of the main device through the armor of the target.

SUMMARY OF THE INVENTION

These objects and others which will become apparent hereinafter are attained, in accordance with the present invention, in a projectile for attacking multiple-layer, preferably active armor, e.g. of an armored vehicle such as a tank, personnel carrier or weapons carrier, which comprises a main device and an auxiliary device, the main device and the auxiliary device being generally similar in configuration and nature, with the main device larger than the auxiliary device and at least the auxiliary device forming an armor-piercing or armor-breaking unit. In such a projectile, the effective point (temporally) of the auxiliary device upon the target precedes that of the main device and facilitates the action of the main device, improving the armor-breaking or armor-piercing effect thereof.

According to the invention, the main device comprises an elongated impact or inertial projectile body which attacks the target substantially by impact and the effect of its kinetic energy thereon while the auxiliary device is similarly an impact-type projectile body.

The main device according to the invention comprises means effective at a predetermined approach of the composite projectile to the target and before the main projectile body becomes effective, to accelerate the auxiliary projective body against the target relative to the main projectile body from the latter in the direction of impact of the composite projectile. Advantageously, the point at which acceleration is initialed is established by a proximity fuse or detector in the main projectile body.

According to a feature of the invention, the main projectile body has a central bore serving as a firing barrel for the smaller diameter elongated auxiliary projectile body and behind the latter within the main projectile body a propellant charge fired by the proximity fuse is provided. This charge thus accelerates the auxiliary projectile body relative to the main projectile body while both continue their flight toward the target on the same path.

In yet another feature of the invention, the proximity fuse is set to assure a predetermined spacing between the auxiliary projectile body and the main projectile body at the point at which the auxiliary projectile body first impacts against the target.

This bore may be provided with lands and grooves forming rifling for the auxiliary impact projectile body to impart rotary stabilization to the latter about its axis.

When the bore forms a smooth-wall barrel for the auxiliary projectile, the latter may be provided with a fin structure for the fin stabilization of the auxiliary inertial or impact body.

Relative to the bore, moreover, the auxiliary impact body can be a subcaliber projectile, i.e. the major portion of its length can have a diameter substantially less than the diameter of the bore.

Alternatively or in addition, the inner auxiliary impact projectile can be provided with a stabilizing plate for resistance stabilization of this projectile body.

The projectile according to the invention is thus significantly simpler than the tandem shaped charge devices mentioned previously and surprisingly is far more effective against active armor than conventional rounds fired by automatic cannon and like weapons thereagainst.

We believe that, in large measure, this surprising effect is due to the fact that conventional rounds from automatic barrel-type weapons may not have sufficient velocity upon encountering the target to be effective in a penetrating manner, especially since such rounds are relatively lightweight compared to impact projectiles which are relatively massive and generally consist of heavy and hard metal in the manner described in application Ser. No. 949,067 now abandoned and replaced by Ser. No. 412,794 filed Aug. 23, 1982. Because both the small auxiliary projectile and the main projectile are bodies of high mass, even if their velocity falls off, as with conventionally fired rounds, their kinetic energy is sufficient to enable them to pierce the structured or multiple-layer armor.

Upon impact of the auxiliary projectile body, moreover, its velocity is substantially higher than that of the main projectile body, having been accelerated relative thereto, so that in spite of its smaller mass, its kinetic energy can be sufficient to penetrate the armor.

In the case of active armor provided with interference charges, moreover, the effect of such charges can be destroyed by the auxiliary projectile body before impact of the main projectile body. Thus the system of the invention has been found to be especially effective against active armor as well as multi-layer targets having ceramic layers or inserts between metal layers.

BRIEF DESCRIPTION OF THE DRAWING

The above and other objects, features and advantages of the present invention will become more readily apparent from the following description, reference being made to the schematic or diagrammatic drawing which accompanies this application. In the drawing.

SPECIFIC DESCRIPTION

Figure 1:
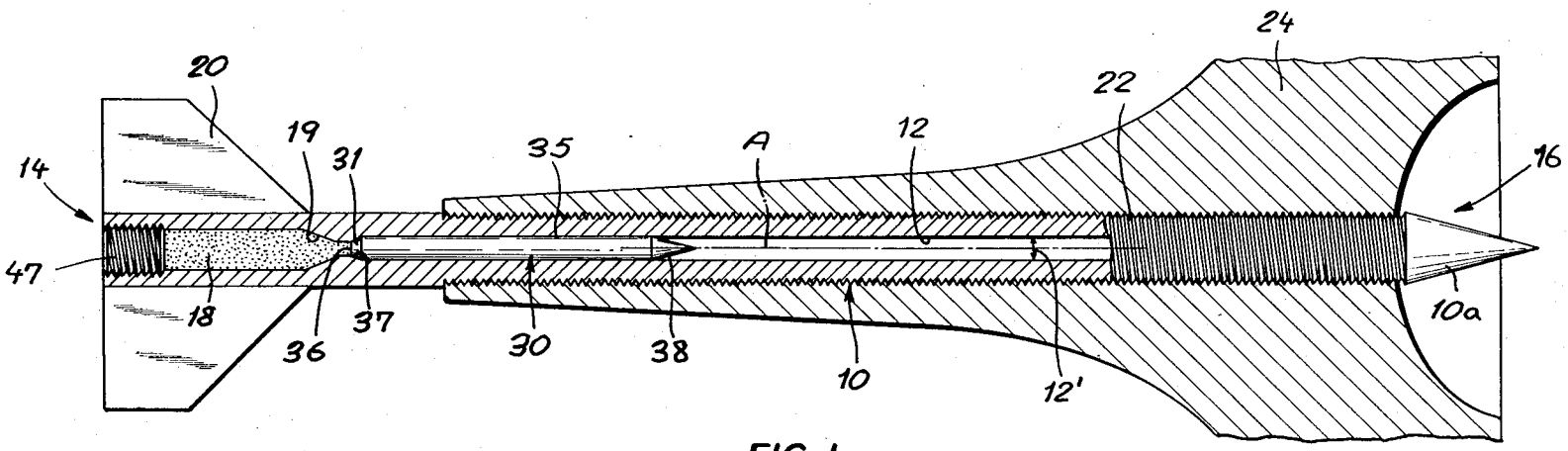
FIG. 1 is a partial axial cross-sectional view through a subcaliber projectile in accordance with the present invention, a portion of the drive cage being shown at the forward leading end of the projectile.
Figure 5:
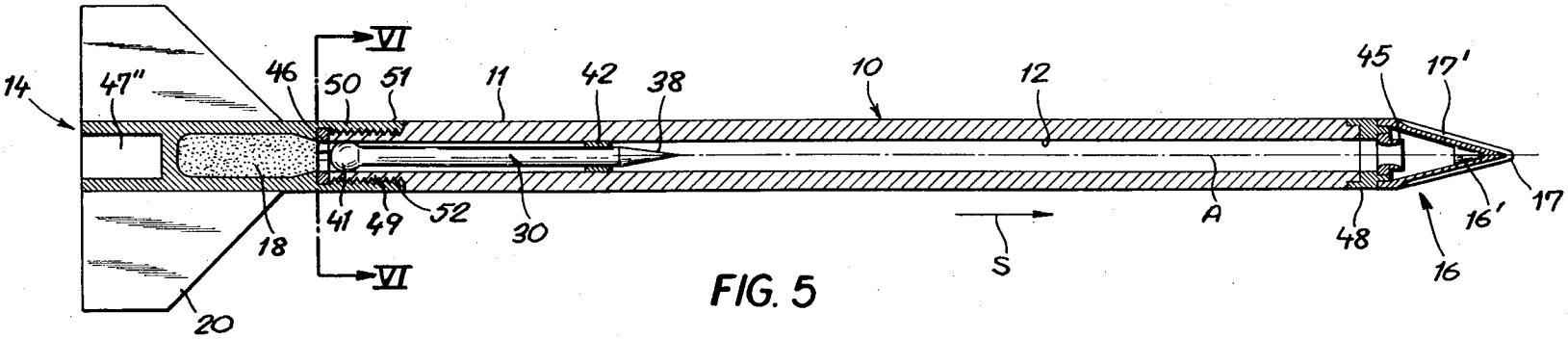
FIG. 5 is an axial section illustrating still another embodiment of the invention.

In FIG. 1, we have shown a subcaliber impact or inertial projectile 10 having a nose cone 10*a* of the readily releasable and dislodgeable type and which may contain a proximity fuse as will be apparent in connection with FIG. 5. The projectile body 10 can be formed from a plurality of penetrating cores as described in the aforementioned copending application, releasably held together so as to impact in succession against a multilayer target.

The projectile shown in FIGS. 1 through 5, however, is particularly effective against so-called active armor, i.e. armor which can be provided with interference charges designed to explode upon impact so as to restrict penetration and to shed the impacting projectile.

Basically each projectile of FIGS. 1 through 5 comprises a central bore 12 forming a barrel which can extend from the bottom or rear end 14 of the projectile body to the forward end or tip 16 thereof.

The outer projectile body 10 is formed with a fin stabilizer 20 at its rear end.

The periphery of this body may be provided with a screw thread 22 upon which a drive cage or sabot 24 can be mounted, this drive cage being of segmental configuration and being designed to break apart in flight of the projectile as it leaves the barrel of the firing cannon.

The drive cage has an outer diameter corresponding to the caliber of the barrel so that the diameter of body 10 is substantially smaller, i.e. the body 10 is a subcaliber projectile.

Drive cages or sabots of this type or for this purpose are also described in the aforementioned copending application (see also the commonly assigned copending applications Ser. No. 068,865 of Aug. 21, 1979 and Ser. No. 086,760 of Oct. 18, 1979).

As noted, the central bore 12 serves as a barrel for an auxiliary projectile body shown as an impact projectile body 30 with a tip or point 38 and a bottom 36.

The auxiliary projectile body 30 is disposed at the rear end of the projectile body 10 and has its bottom end 36 in the region of a propellant charge 18 disposed in a large-diameter compartment at the rear end 14 of body 10.

A proximity fuse 16' (see FIG. 5) is connected to a primer for firing the charge 18 in a manner not shown but conventional in the art. The proximity fuse 16' is adjustable to establish the distance from the target at which it is to respond and hence the distance from the target of the projectile before the charge 18 is fired and the auxiliary projectile body 30 driven through the bore 12 against the target and accelerated relative to the projectile body 10.

By this adjustment, it is simple to allow compensation for each projectile for the structure of the active armor in an optimum manner since the spacing of the impacts (against the target) between the first projectile 30 and the second projectile 10 can be set with ease.

In the region of the end 36 of the auxiliary impact body 30, the latter body is formed with a frustoconical surface 31 between the chamber housing the charge 18 and the bore 12.

The charge chamber frustoconically converges toward a cylindrical portion as shown at 19 which opens into the frustoconically divergent portion 31.

This construction promotes the propulsion of the projectile body 30 from the bore 12.

The primer or igniter 47 is screwed into the rear end of the projectile body 10.

Figure 2:
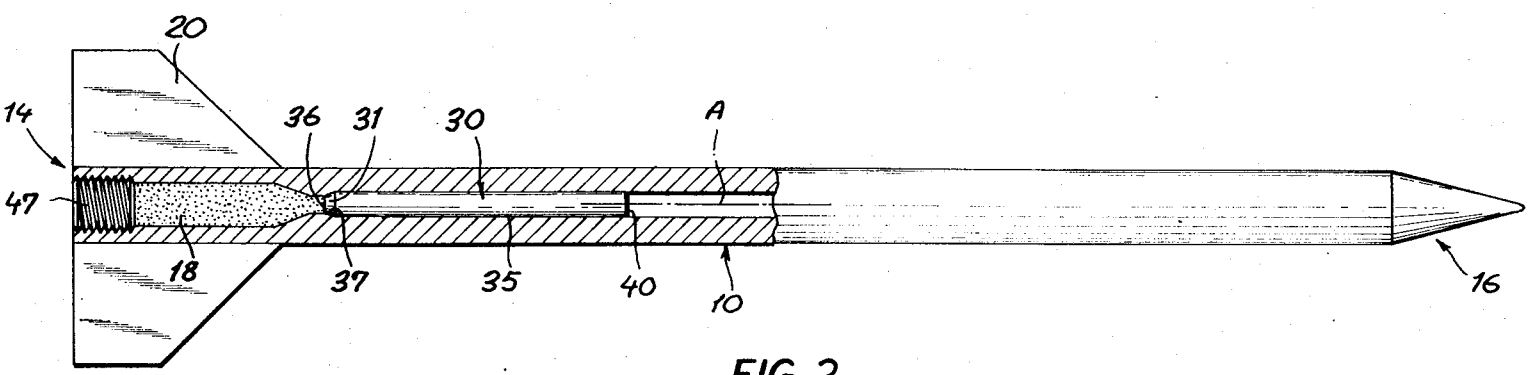
FIG. 2 shows a subcaliber projectile according to another embodiment of the invention, the drive cage being omitted.

The embodiment of FIG. 2 differs from that of FIG. 1 in that the leading end of the auxiliary impact projectile body 30 is formed with a flat face 40 rather than the point 38. In both FIGS. 1 and 2, the bodies 30 are full caliber bodies, i.e. the shank 35 of the body is of uniform diameter over its entire length and corresponds to the diameter 12' of the bore 12.

In these embodiments, therefore, the surface 12' of the bore 12 can be formed with lands and grooves in a helical pattern (i.e. rifling) to impart spin stabilization to the projectile 30 when it is fired from the projectile 10.

Figure 3:
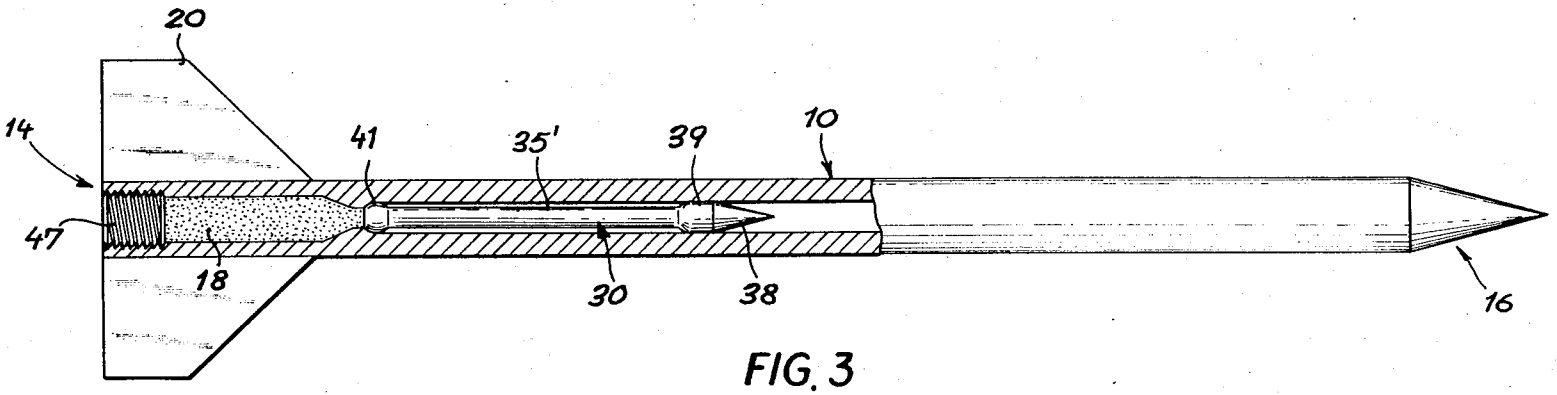
FIG. 3 shows, also in fragmentary axial cross section, a subcaliber projectile with its drive cage omitted and in which the auxiliary projectile body is of the subcaliber type as well.

The embodiment of FIG. 3 differs from that of FIGS. 1 and 2 in that the major portion of the length 35' of the shank of the auxiliary body is of smaller diameter than the bore and only flanges or bulges 39 or 41 at opposite ends of this projectile have diameters equal to the caliber of the bore. This arrangement has the advantage that the friction is reduced as with subcaliber projectiles.

Figure 4:
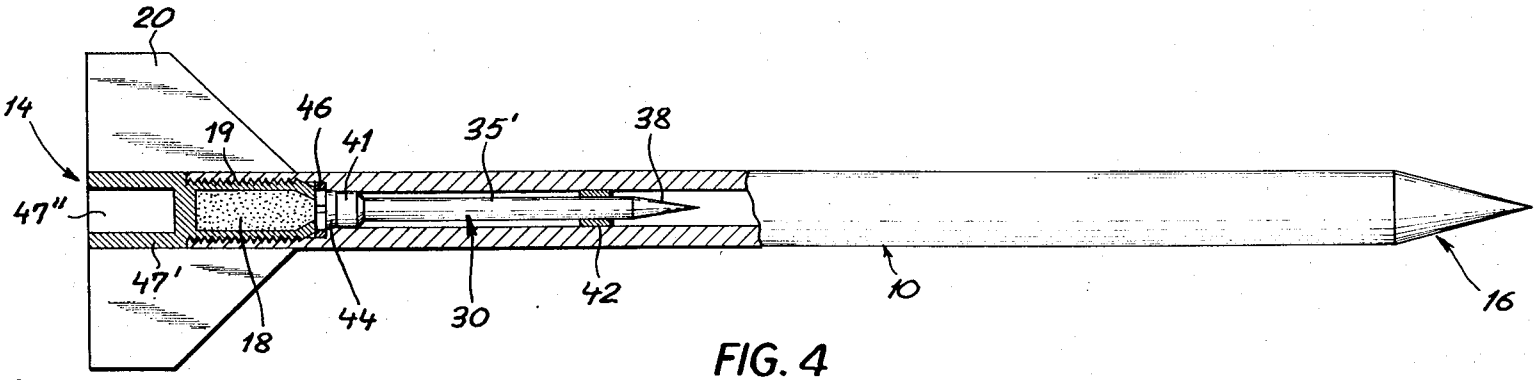
FIG. 4 shows in diagrammatic axial section another embodiment of the invention utilizing a generally subcaliber auxiliary projectile body.

Another subcaliber arrangement is shown in FIG. 4 in which the auxiliary impact body is subcaliber with the exception of its rear end flange 41. The shank 35' extends from this rear flange 41 to the point 38 and, in the region of this point, is surrounded by a guide ring 42 which can form a sort of drive cage if desired. The ring 42 can have breakaway points similar to those of a drive cage so that it separates from the projectile upon its firing from the bore 12.

A frustoconical seat 43 is engaged by a transfer cone 44 between a cross-slot disk 46 (see FIG. 6) which separates the charge 18 from the projectile 30 and prevents shocks from being transmitted by the projectile 30 to the propellant charge when the projectile 10 is fired.

A sleeve 47', containing a recess 47, contains the charge 18 and forms the chamber thereof while being threaded into the body 10 as shown. The primer can be inserted into the recess 47. Communication between the primer and the charge 18 is of course also provided.

When the projectile of FIG. 4 is fired, the barrier 46 and the frustoconical member 44 are destroyed and the propellant drives the auxiliary impact body out of the bore 12.

As can be seen from FIG. 5, the body 10 is formed in the region of its tip 16 with breakaway lines or joints 17' by which the ballistic conical cap 17 forming this tip can separate to allow the auxiliary body to be fired from the bore 12.

The base of the ballistic 10 is seated upon a retaining ring 48 whose mouth is formed with a stabilizing plate 45 whose inner diameter is the same as the outer diameter of the projectile body 30 so as to stabilize the latter concentrically as it emerges from the bore 12, this projectile tearing the plate 45 therewith.

The proximity fuse has been shown at 16' and is, of course, connected with the primer of the charge 18 in a conventional manner.

The projectile body 10 has a reduced diameter rear portion 49 upon which the sleeve 50 is threadedly mounted, this sleeve serving to clamp the disk 46 is place to accommodate the propellant charge 18. A recess 47 in the sleeve member 50 is also provided for the primer. The fin stabilizer 20 for the composite projectile is also mounted on this sleeve. The interconnecting screw thread is represented at 52 and the outer surface 51 of the sleeve is flush with the outer surface 11 of the projectile body 10.

Figure 6:
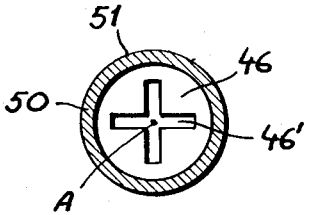
FIG. 6 is a section taken along the line VI—VI of FIG. 5 but corresponding to a similar cross section for each of the embodiments of FIGS. 1 through 4.

The cross slit 46' in disk 46 has been shown in FIG. 6.

The projectile shown in FIGS. 1 through 5 is placed in a casing as is conventional practice with a propellant charge and is fired from the barrel of a weapon, the drive cage 24 being torn away as the projectile emerges from the barrel.

As the projectile approaches the target, at a given distance therefrom, the proximity fuse 16' fires the charge 18 and the gases accelerate through the slot 46' and the frustoconical formations which form constrictions adjacent the rear end of the projectile body 30 to accelerate the propellant gases. The auxiliary projectile body 30 is thus driven along the axis A in the direction S in which the projectile body 10 also approaches the target.

Upon engagement with the stabilizing disk 45, the latter breaks awas from the projectile 10 and is carried along with the body 30, the cap 17 being destroyed and likewise permitting free flight of the auxiliary body 30. The stabilizing disk 45, as the body moves therethrough, is captured by the rear flange 41 of the projectile body.

The projectile body 30 emerges from the bore 12 with a higher velocity than the body 10 and thus encounters the target with a high kinetic energy. The target armor is partially or completely penetrated by the auxiliary body 30 and at the same location, the main body 10 impacts against the target, completing the destruction of the armored wall and penetration of the vehicle.

Figure 8:
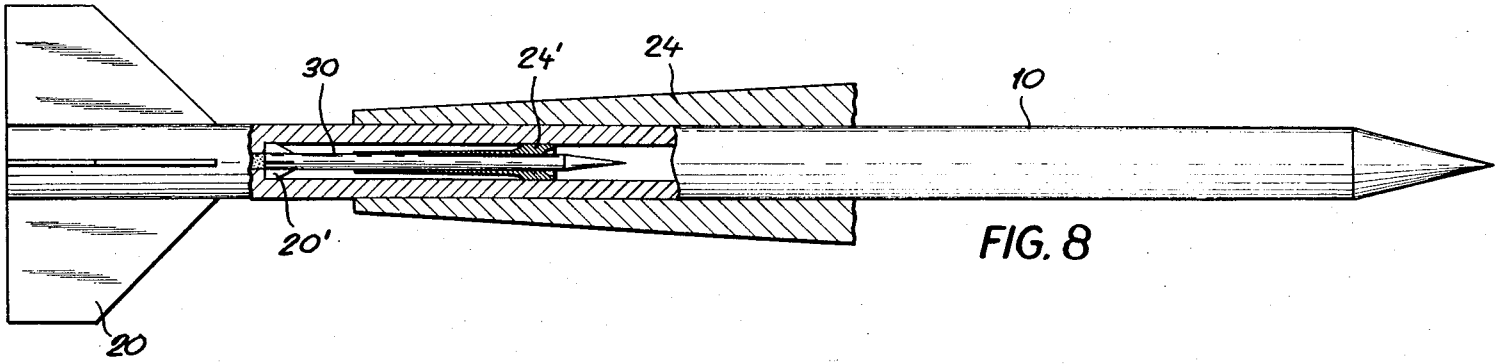
FIG. 8 is a fragmentary cross-sectional view showing a portion of a projectile in which the auxiliary projectile body is a subcaliber projectile provided with a drive cage and stabilizing fins.
Figure 7:
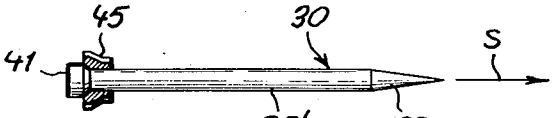
FIG. 7 is an elevational view, partly broken away, showing another embodiment of the auxiliary projectile body according to the invention.

The auxiliary projectile body can also be fin-stabilized as shown in FIG. 8 and the stabilizing disk 45 on the end of the body 30 (FIG. 7) can be provided with longitudinal grooves or a coil arrangement to promote twist or spin stabilization of this body. Because of the high relative speeds of the projectile body 30 and the body 10, the flight path of the former within the latter can be relatively small and hence resistance stabilization can be provided without disadvantages resulting from deviation from the desired ballistic flight path. Because of the short flight path of the inner projectile body, the point 38 is not required and a flat surface can be provided as shown at 40.

The high speed of the inner projectile body relative to the outer projectile body thus permits the stabilizing disk 45 to encounter the rear flange 41 without disturbing the flight path of the inner projectile body.

As already indicated, a projectile fired from an automatic weapon loses a good part of its velocity by the time it reaches the target so that its kinetic energy may be insufficient. With impact projectiles, a material increase in the available kinetic energy results from the high mass of the impact bodies.

Because of the high velocity of the auxiliary impact body 30 against the target, the armor-breaking effect can be the same as a projectile fired from an automatic weapon with a mass which is a factor of two to three times less than that of the projectile fired by the automatic weapon.

Because the mass of the outer projectile body 10 is substantially greater than that of the inner projectile body, the effect of firing the charge 18 in slowing down the body 10 is minimal and the inner projectile body can be driven against the armor with especially high kinetic energy to penetrate the latter not only if it is an active armor but also if it is layered with ceramic plates, buckling plates or the like.

Thus, in spite of the fact that modern armoring requires 30 to 80% higher ballistic energy for piercing or breaking the armor than earlier simple steel armoring, the projectiles of the present invention are effective thereagainst because the small auxiliary projectiles 30 can be given the necessary higher kinetic energy for piercing the armor and facilitating the penetration by the main projectile body 10.

From FIG. 8, it can be seen that the auxiliary projectile body 30 can have a drive cage similar to that shown at 24 and represented at 24' in addition to a stabilizing fin assembly 20'.

The cross-slotted disk 46 not only provides a physical protection to the propellant 18 against rearward force from the inner projectile body 30 upon firing of the composite projectile, but at relatively low cost forms an excellent distributor for the propellant gases which promotes the reproducible firing of the auxiliary projectile.

We claim:

1. A composite projectile for armored targets, especially active-armor and multilayer-armor targets, comprising:

an elongated subcaliber main projectile body of substantially uniform diameter over its length forming an armorbreaking inertial impact element which is fired at an armored target, said main body being provided with a detachable sabot and stabilizing fins;

a single solid elongated auxiliary projectile body of substantially uniform diameter over its length received in said main projectile body and forming an inertial impact element adapted to break armor of said target, said main projectile body being substantially longer than said auxiliary projectile body;

a proximity fuse on said main body adapted to respond to approach of the composite projectile to said target; and a propellant charge in said main projectile for firing said auxiliary projectile body therefrom in response to said proximity fuse whereby, as said projectile approaches said target and at a predetermined distance therefrom, said auxiliary projectile body is fired from said main projectile body and impacts said target whereupon said main projectile body impacts said target in the same region, said main projectile body being formed with a single axially extending central bore having a diameter corresponding to that of a portion of said auxiliary projectile body and of a length exceeding that of said auxiliary projectile body, said auxiliary projectile body being received in said bore at a rear portion thereof and being guided therein upon firing from said main projectile body, said charge being disposed in a chamber formed in said main projectile body at a rear end thereof communicating with said bore.

2. The projectile defined in claim 1 wherein said proximity fuse is adjustable to set the distance from said target at which said auxiliary projectile body is fired through said bore from said main projectile body.

3. The projectile defined in claim 1 wherein said bore is formed with lands and grooves constituting rifling for imparting spin stabilization to said auxiliary projectile body upon firing thereof from said bore against said target.

4. The projectile defined in claim 1 wherein said auxiliary projectile body is formed with a fin assembly at a rear end thereof for fin stabilization of said auxiliary projectile body upon diring thereof from said main projectile body.

5. The projectile defined in claim 1 wherein said auxiliary projectile body is subcaliber at least over a major part of its length with respect to said bore.

6. The projectile defined in claim 1, further comprising a stabilizing disk adapted to engage said auxiliary projectile body for the resistance-stabilization thereof.

7. The projectile defined in claim 1, further comprising a detachable ballistic cap at a front end of said main projectile body housing said proximity fuse.

* * * * *